US006490780B1

(12) United States Patent
Kim et al.

(10) Patent No.: US 6,490,780 B1
(45) Date of Patent: Dec. 10, 2002

(54) METHOD FOR MAKING A COMMUTATOR

(75) Inventors: Chul Kim, Anyang (KR); Yong-woon Han, Kunpo (KR); Seong-deog Jang, Suwon (KR); Han-jun Sung, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/831,158

(22) PCT Filed: Dec. 26, 1998

(86) PCT No.: PCT/KR98/00471

§ 371 (c)(1),
(2), (4) Date: May 7, 2001

(87) PCT Pub. No.: WO00/28630

PCT Pub. Date: May 18, 2000

(30) Foreign Application Priority Data

Nov. 11, 1998 (KR) ..... 98-48169

(51) Int. Cl.[7] ..... H01R 43/10

(52) U.S. Cl. ..... 29/597; 310/233; 310/234; 310/235; 310/236; 310/237

(58) Field of Search ..... 29/596, 597; 310/234, 310/239, 237, 235, 233, 236

(56) References Cited

U.S. PATENT DOCUMENTS 1,883,736 A * 10/1932 Cotterman
2,449,309 A * 9/1948 Moeller
2,696,658 A * 12/1954 Poland
2,967,283 A * 1/1961 Medney
4,559,464 A * 12/1985 Stokes
4,890,377 A * 1/1990 Ebner
5,353,492 A * 10/1994 Potocnik et al.
5,933,939 A * 8/1999 Nomerange et al.
6,236,136 B1 * 5/2001 Hockaday et al.
6,294,850 B1 * 9/2001 Yui et al.
6,392,325 B2 * 5/2002 Fujii et al.

FOREIGN PATENT DOCUMENTS

RU 1 755 349 A 8/1915

OTHER PUBLICATIONS

Soviet document, SU1 755 349A1 Prokopevsk E., dated Aug. 15, 1992, published in the *Soviet Inventions Illustrated*, Section S–X, Week 9334, on the 13th of Oct. 1993, by Derwent Publication Ltd., London.

* cited by examiner

*Primary Examiner*—Carl J. Arbes
(74) *Attorney, Agent, or Firm*—Robert E. Bushnell, Esq.

(57) ABSTRACT

A method for making a commutator comprising steps of arranging at least one pair of commutator members to be spaced apart from each other, and molding a product by injecting an insulating resin; shaping the product to the product having a real circular sectional cross section; heating the product to a predetermined temperature; cutting protruding resin portions between the commutator members, to the align outer circumference of the commutator body with the outer surfaces of the commutator members. The predetermined temperature is that which rises when the commutator is rotated, and accordingly the predetermined temperature ranges from sixty to eighty degrees Centigrade (60° C.–80° C.). The finished commutator has grooves on the commutator body between the commutator members. The grooves undergo thermal expansion when the commutator is rotated and the temperature rises to a predetermined degree, so that the commutator has a real circular sectional cross section. Accordingly, the contact between the commutator and the input and output brushes is properly performed, and no noise occurs.

3 Claims, 6 Drawing Sheets

FIG.7

Unit : μm

| °C \ SPOT | a | b | c | d | e | f | g | h | i | j | k | l | m | n | o | p | q | r | s | t | u | v | w | x |
|---|---|---|---|---|---|---|---|---|---|---|---|---|---|---|---|---|---|---|---|---|---|---|---|---|
| 100 °C | 0 | 0 | −5 | −4 | 1 | 0.5 | −1 | −5 | −1 | −1 | −6 | −4 | 0 | 0 | −6 | −7 | 0.5 | 0 | −6 | −4 | 1.5 | 1 | −4 | −4 |
| 80°C | 0 | 2 | −3 | −4 | 2.5 | 1.5 | −3 | −5 | 1.5 | 2 | −4 | −4 | 2.5 | 1.5 | −5 | −7 | −1 | 0 | −4 | −7 | 1.5 | 0.5 | −5 | −5 |
| 60°C | 0 | −1 | −3 | −3 | −1 | 1.5 | −3 | −3 | 0.5 | 0.5 | −2 | −3 | 2 | 2 | −2 | −1 | 2 | 1.5 | −2 | −4 | 0 | −1 | −4 | −4 |
| 40°C | 0 | 0.5 | −3 | 0 | −2 | −4 | −5 | −1 | −1 | −3 | −4 | −1 | −1 | −3 | −4 | 0.5 | 0 | −2 | −2 | 0.5 | 0 | −1 | −2 | 0 |

METHOD FOR MAKING A COMMUTATOR

TECHNICAL FIELD

The present invention relates to a method for making a commutator which is capable of properly contacting with a brush and preventing any noise production by heating a molded product and by cutting protruding portions caused due to thermal expansion.

BACKGROUND ART

Generally, a commutator is an electric device comprising at least a pair of commutator members of a conductive material, and a commutator body of an insulating material. The commutator body supports the commutator members so that the commutator members can be properly spaced apart from each other and insulated. Thus, electric current inputted through an input brush can be transmitted to an output brush through the commutator members, and in such a situation, Direct Current (hereinafter referred to as DC) is inverted into Alternating Current (hereinafter referred to as AC), and vice versa.

Such a commutator is made by the method illustrated in FIG. 1, and will be briefly described below.

First, commutator members 132 are made of conductive materials such as copper, etc. The commutator members 132 are formed by drawing, or rolling process. Then, a plurality of such formed commutator members 132 are arranged around an inner circumferential surface of a metal mold 102 in a radial manner.

Then, an insulated resin such as phenol resin is injected or extruded into an inner space of the metal mold 102. Such injected or extruded insulating resin forms a commutator body 135.

Then, an unfinished product is separated from the metal mold 102 and shaped by a lathe to become a complete real circular-cross sectioned product.

The conventional method for making the commutator, however, has the following drawback.

While the commutator is rotated, heat is produced by the friction between the outer circumferential surface of the commutator and the input and output brushes, and also by the electrical resistance of the commutator members 132. Accordingly, deformities appear on the surface of the commutator.

It has been proved that the temperature of the commutator rises approximately to sixty to eighty degrees Centigrade (60° C.–80° C.) by the friction, or the electrical resistance when the commutator is rotated. Accordingly, the commutator body 135 and the commutator members 132 experience thermal expansion. The problem that arises is that the coefficients of thermal expansion of the commutator body 135 and the commutator members 132 are not same. That is, the commutator body 135 made of the resin material has greater coefficients of thermal expansion than those of the commutator members 132 made of metal. Accordingly, as shown in FIG. 2, the commutator body 135 expands outward between the commutator members 132, and form protruding portions having a predetermined length (d). Here, the length (d) of the protruding portions of the commutator body 135 are a few micrometers ($\mu$m) so that it is hardly noticeable to the naked eye. In FIG. 2. however, the protruding portions are overemphasized for better understanding.

Thus, as some portions of the outer circumferential surface of the commutator body 135 protrude, the commutator body 135 can not make proper contact with the input and output brushes 122 and 124, and performance reliability is deteriorated, accordingly. Further, considerable noise is produced between the commutator and the input and output brushes 122 and 124.

DISCLOSURE OF INVENTION

An object of the present invention is to provide a method for making a commutator whose body does not protrude between the commutator members while the commutator body and the commutator members experience thermal expansion during the rotation of the commutator.

The above object will be accomplished by a method for making a commutator according to the present invention comprising the steps of arranging at least one pair of commutator members inside a metal mold in such a manner that the commutator members are spaced apart from each other, molding a product by injecting an insulating resin into the mold; shaping the molded product to the product having a real circular sectional cross section; heating the product to a predetermined temperature; and cutting the protruding portions of the commutator body caused by thermal expansion so as to align the outer circumference of the commutator body with the surface of the commutator members. Here, the predetermined temperature approximately ranges from sixty to eighty degrees Centigrade(60° C.–80° C.).

According to the commutator of the present invention, grooves are defined at the commutator body between the commutator members. Due to the presence of the grooves, the sectional cross section of the commutator can form a complete spherical shape when the commutator body undergoes thermal expansion due to the temperature rising while the commutator is rotated. Accordingly, the commutator and the input and output brushes properly contact each other, and noise does not occur.

BRIEF DESCRIPTION OF THE DRAWINGS

The above object and advantages will be more apparent by describing the preferred embodiment in greater detail with reference to the accompanied drawings, in which;

FIG. 7 is a table for showing respective measurements of the depths of the grooves of the commutator made according to the present invention.

BEST MODE FOR CARRYING OUT THE INVENTION

Figure 1:
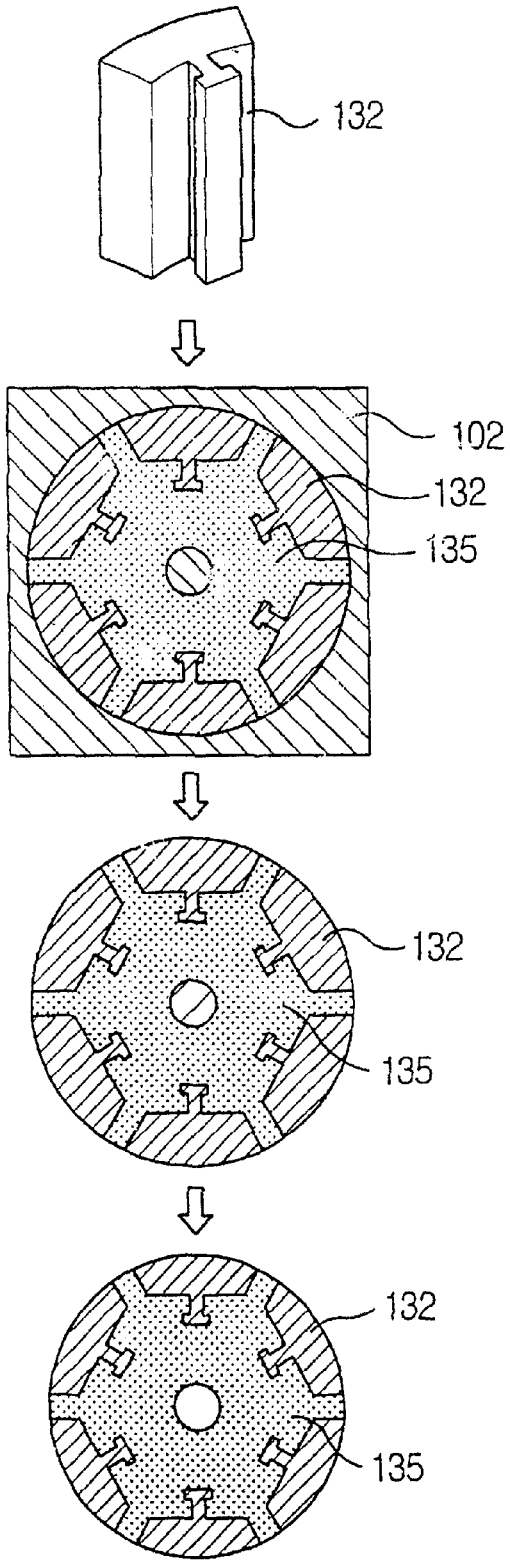
FIG. 1 is a view for explaining a method for making the conventional commutator.
Figure 2:
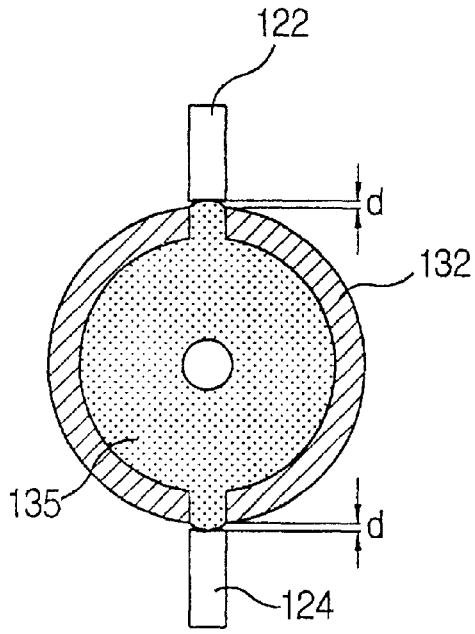
FIG. 2 is a sectional view for explaining problems of the commutator made by the conventional method.
Figure 3:
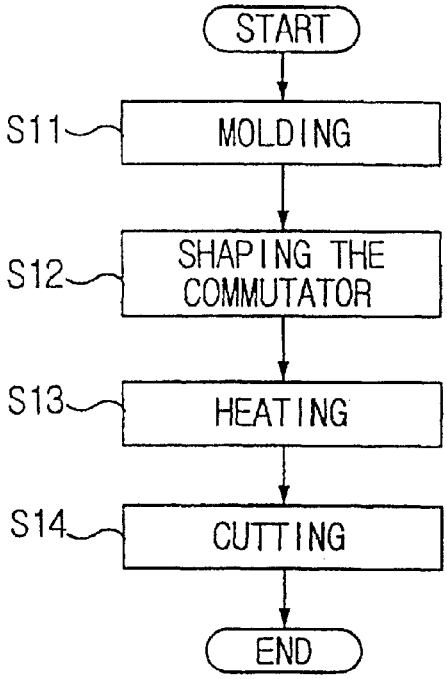
FIG. 3 is a flow chart for explaining the method for making the commutator according to the present invention.

FIG. 3 is a flow chart for explaining a method for making a commutator according to the present invention.

As shown, the method for making the commutator according to the present invention comprises a molding step (Step S11), a shaping step (Step S12) in which a molded unfinished product is shaped to the product having a real circular sectional cross section, a heating step (Step S13) in which the product is heated, and a cutting step (Step S14) in which the protruding portions caused by thermal expansion are cut.

In the molding step (Step S11), at least one pair of the commutator members are arranged within a metal mold, while spaced from each other, and an insulating resin is molded by injection.

Then, the unfinished product is separated from the metal mold, and shaped to have a real circular sectional cross section by cutting means such as a lathe (Step S12), or the like.

Figure 4:
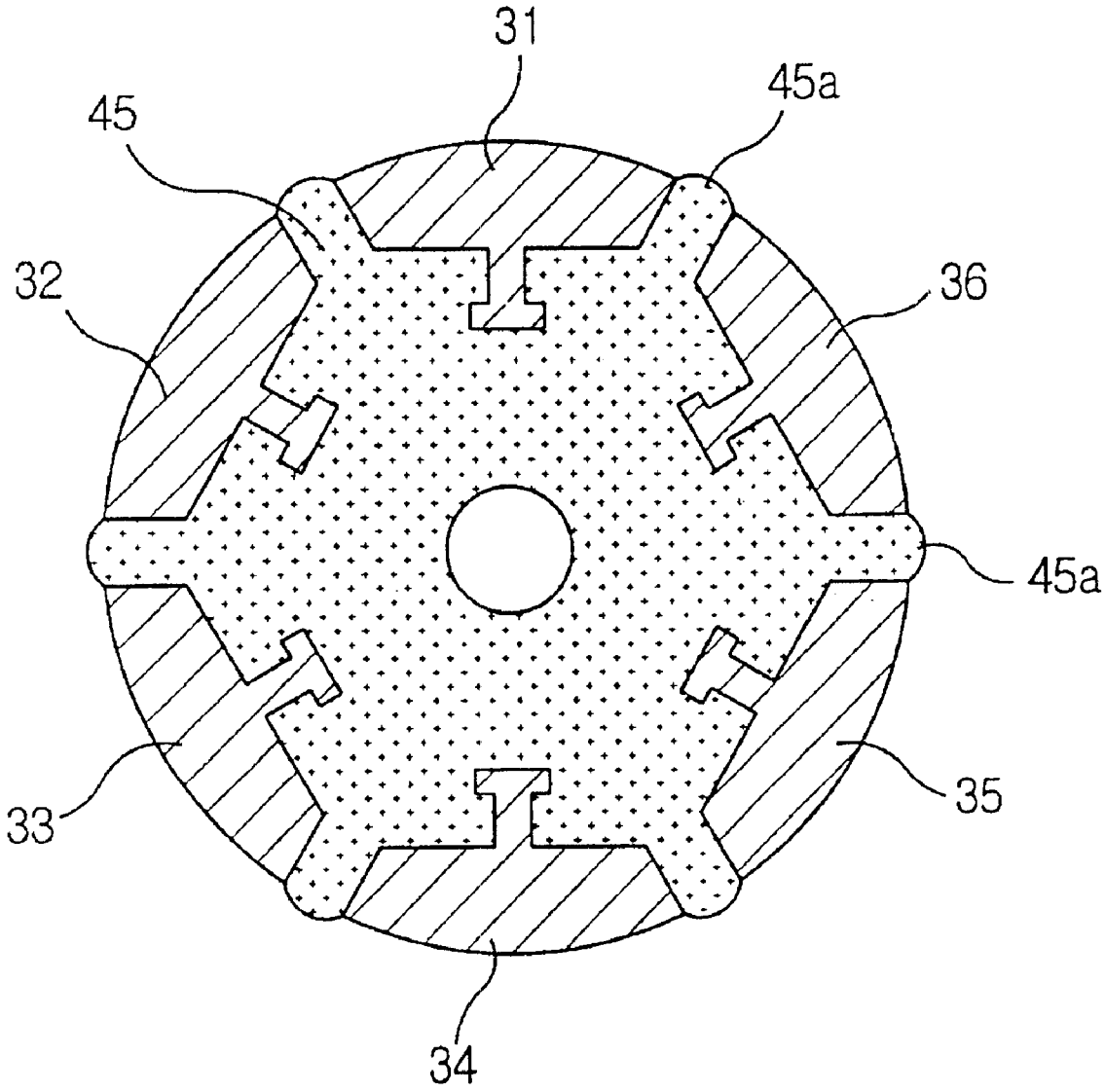
FIGS. 4 to 6 are sectional views for showing shapes of the commutator varying in each of the steps shown in FIG. 3.

The product such shaped is then heated (Step S13). Then, the commutator body 45 and the commutator members 31–36 undergo thermal expansion. In this situation, since the coefficients of thermal expansion of the commutator body 45 are greater than those of the commutator members 31–36, some portions of the commutator body 45 are expanded which form the protruding portions 45*a*. The length of the protruding portions 45*a* are within a few micrometers (μm), so that they are hardly noticeable to the naked eye. In FIG. 4, however, the protruding portions 45*a* are overemphasized for better understanding. Here, the predetermined temperature is the temperature of the finished commutator which is rotated, and accordingly, the temperature preferably may range from sixty degrees Centigrade to eighty degrees Centigrade (60° C.–80° C.) for heating the commutator.

Figure 5:
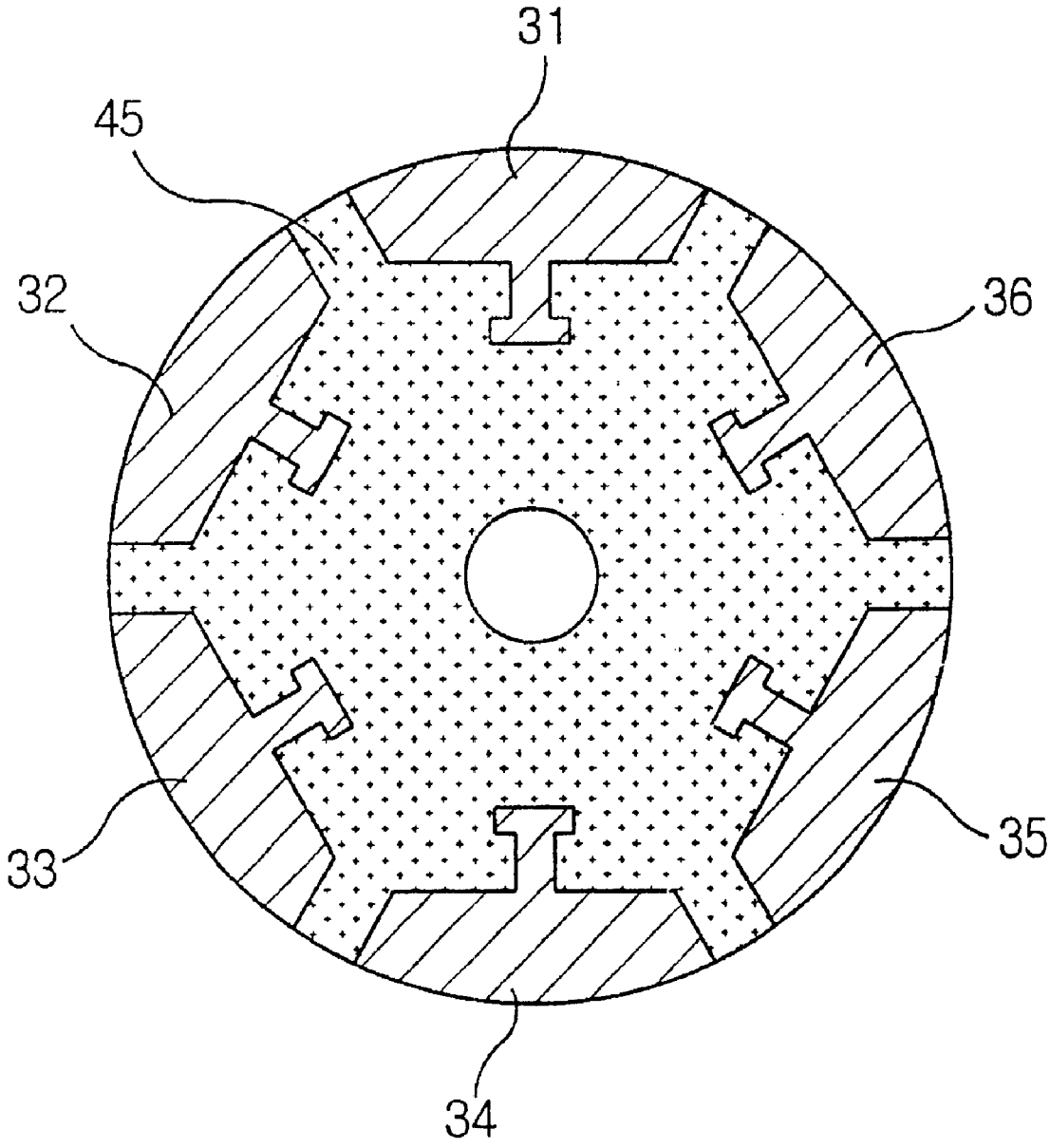
Figure 6:
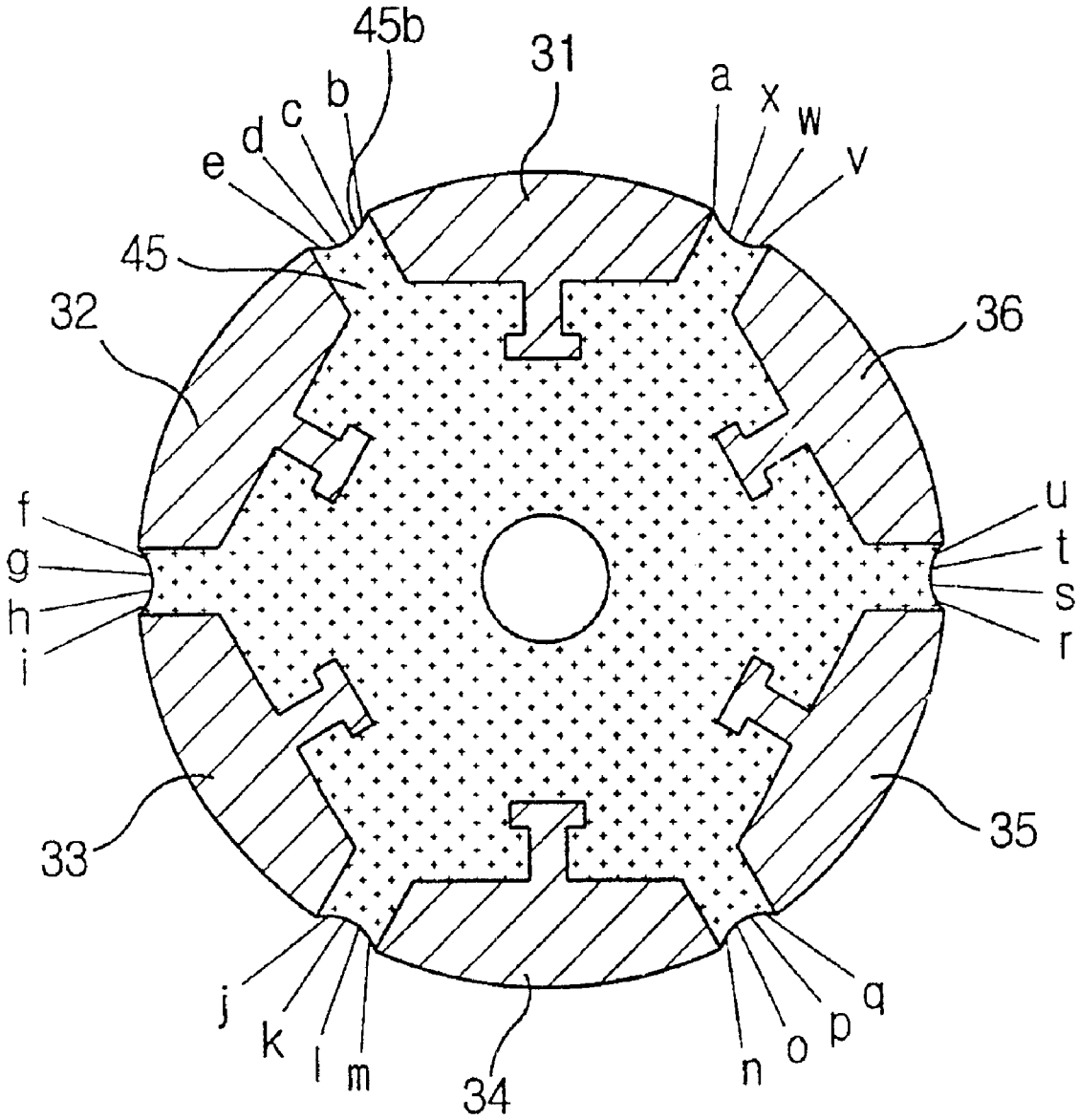

Then, in a state that the unfinished product is heated, the protruding portions 45*a* are cut by a cutting means such as a lathe (Step S14), so that the outer circumferential surfaces of the commutator body 45 are aligned with the surfaces of the commutator members 31–36. Accordingly, the unfinished product is shaped to have a real circular sectional cross section as shown in FIG. 5. As shown in FIG. 6, since the protruding portions 45*a* are cut to be aligned with the surfaces of the commutator members 31–36, grooves 45*b* are formed at the commutator body 45 when the product is cooled to a normal temperature and accordingly when the commutator body 45 contracts.

FIG. 7 shows the results of depth measurements of the grooves 45*b* of the commutator made according to the present invention. In this case, the commutator having a 25 mm of diameter is heated respectively to forty degrees Centigrade (40° C.), sixty degrees Centigrade (60° C.), eighty degrees Centigrade (80° C.), and one hundred degrees Centigrade (100° C.), then cut and cooled. (a) to (x) in FIG. 7 indicate respective spots of outer surface of the commutator shown in FIG. 6. In FIG. 7, the spot (d) is one spot of the groove 45*b* defined while the commutator is heated to one hundred degrees Centigrade (100° C.) and cut. The depth of the spot (d) is 4 micrometers (μm).

Without considering individual characteristics of the respective commutators, the grooves 45*b* having an ideal depth can be easily defined by heating the commutator to the predetermined temperature which is measure when the commutator is rotated.

The finished commutator made by the method according to the present invention initially has grooves 45*b* as shown in FIG. 6. Then, when the commutator is rotated so that the temperature rises, the commutator body 45 undergoes thermal expansion so that the outer circumference of the commutator body 45 is aligned with the outer surfaces of the commutator members 31–36. Accordingly, the commutator and the brushes make proper contact with each other, and no noise occurs.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A method for making a commutator comprising steps of:

arranging at least one pair of commutator members to be spaced apart from each other, and molding a product by injecting an insulating resin;

shaping the product to the product having a real circular sectional cross section;

heating the product to a predetermined temperature;

cutting resin portions of the commutator body, which have been protruding between the commutator members, to align the outer circumference of the commutator body with the outer surfaces of the commutator members.

2. A method as claimed in claim 1, wherein the predetermined temperature is that which rises when the commutator is rotated.

3. A method as claimed in claim 2, wherein the predetermined temperature ranges from sixty to eighty degrees Centigrade (60° C.–80° C.).

* * * * *